United States Patent [19]

Horak et al.

[11] 4,162,067

[45] Jul. 24, 1979

[54] AIR ASSISTED AUTOMATIC DOCUMENT STACKING APPARATUS

[75] Inventors: Anthony Horak, Detroit; Felix A. Rachiatore, Rochester; Christopher O. Lada, Ann Arbor, all of Mich.

[73] Assignee: Burroughs Corporation, Detroit, Mich.

[21] Appl. No.: 827,588

[22] Filed: Aug. 25, 1977

[51] Int. Cl.[2] ..... B65H 29/38

[52] U.S. Cl. ..... 271/177; 271/195; 271/211

[58] Field of Search ..... 271/177-181, 271/194, 195, 211

[56] References Cited

U.S. PATENT DOCUMENTS

| | | | |
|---|---|---|---|
| 2,645,480 | 7/1953 | Long | 271/177 |
| 3,078,089 | 2/1963 | Maidment | 271/177 X |
| 3,101,942 | 8/1963 | Zyber | 271/177 |
| 3,834,799 | 9/1974 | Blosser | 271/195 X |
| 3,865,365 | 2/1975 | Hardin | 271/178 X |
| 4,033,579 | 7/1977 | Stange | 271/195 |
| 4,066,254 | 1/1978 | Stange | 271/195 X |

*Primary Examiner*—Richard A. Schacher

*Attorney, Agent, or Firm*—Carl Fissell, Jr.; Kevin R. Peterson

[57] ABSTRACT

Air assisted document stacking apparatus wherein document items are moved into a directional control channel including a pair of rotatable rollers operating in offset relationship with respect to an elongated drive belt effective to entrain and move said items into a stacker pocket, the latter having means for applying positive air pressure to said pocket so as to move incoming items out of the path of following items entering the pocket and for applying negative pressure to said pocket for closely stacking items together in said pocket by removing residual air from between said items.

9 Claims, 8 Drawing Figures

AIR ASSISTED AUTOMATIC DOCUMENT STACKING APPARATUS

BACKGROUND OF THE INVENTION

1. Field of the Invention

The invention relates to document stacker apparatus and more particularly to so-called "stand alone" or desk-top type of stacker apparatus.

2. Prior Art

Known prior art item stacker/readers are generally costly, cumbersome and unsuitable for desk-top operation due to the overall size and operational complexity thereof. In addition, many such pieces of apparatus require relatively substantial mechanical and electrical item stacking arrangements which entail extra maintenance and service should breakdown occur.

The present stacker/reader comprises a relatively simple, easy to operate, automatic desk-top device employing relatively few parts and utilizing both positive and negative air pressure obtained from a single uncomplicated source to stack items such as checks at high speed without interference between items entering the stacker hopper and succeeding items attempting to enter the stacker.

SUMMARY OF THE INVENTION

The present invention is a self-contained, desk-top, modular apparatus for automatically stacking items such, for example, as checks and similar documents at high speed in a stacker pocket without interference between items entering or already within the hopper. That is to say, the apparatus avoids the problems due to an overlap or collision, both of which situations contribute to mis-sorting and misordering of items.

The present apparatus includes in combination a MICR reading station for reading the magnetically encoded data from the items and means for stacking the items in a stacking hopper by utilizing both positive and negative air pressure in the stacker instead of conventional moving rollers, belts, pulleys, augurs, etc. as heretofore employed.

DETAILED DESCRIPTION OF THE INVENTION

Figure 1:
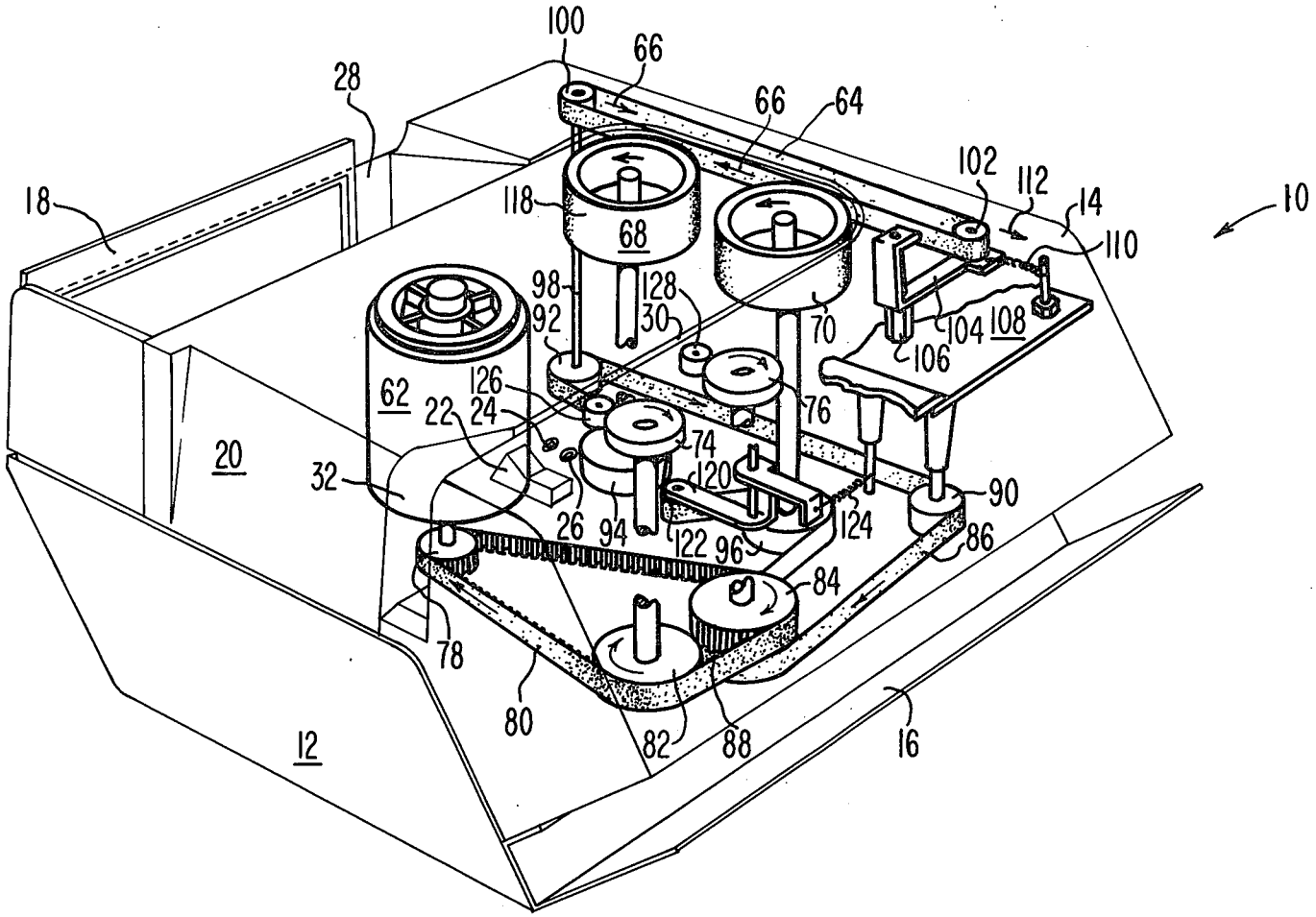
FIG. 1 is a three quarter front perspective view of the apparatus embodying the present invention illustrating the drive train for moving items therethrough.
Figure 2:
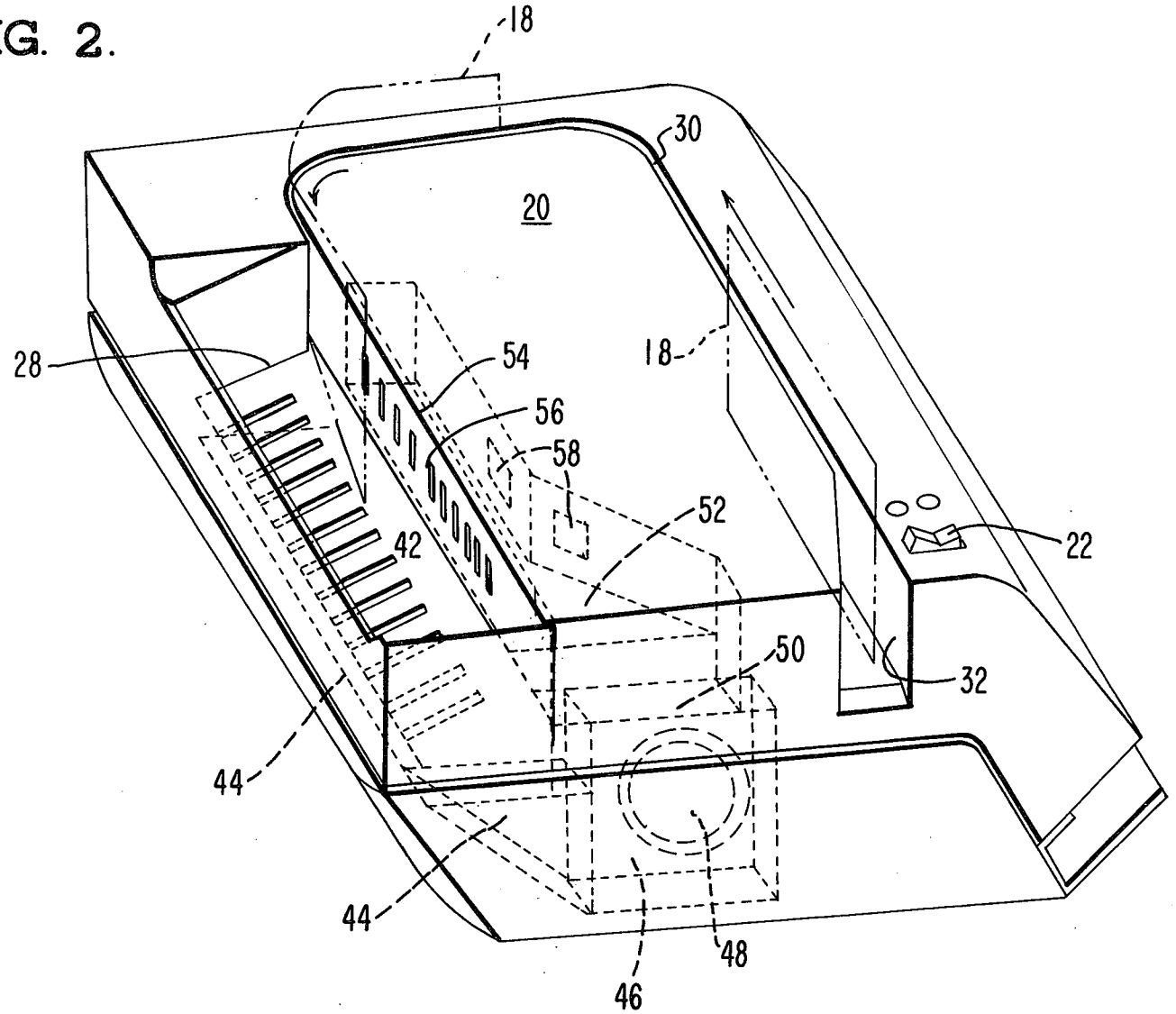
FIG. 2 is a three quarter rear perspective view of the apparatus of FIG. 1 illustrating the means providing the positive-negative air path for the stacker portion of the apparatus.
Figure 3:
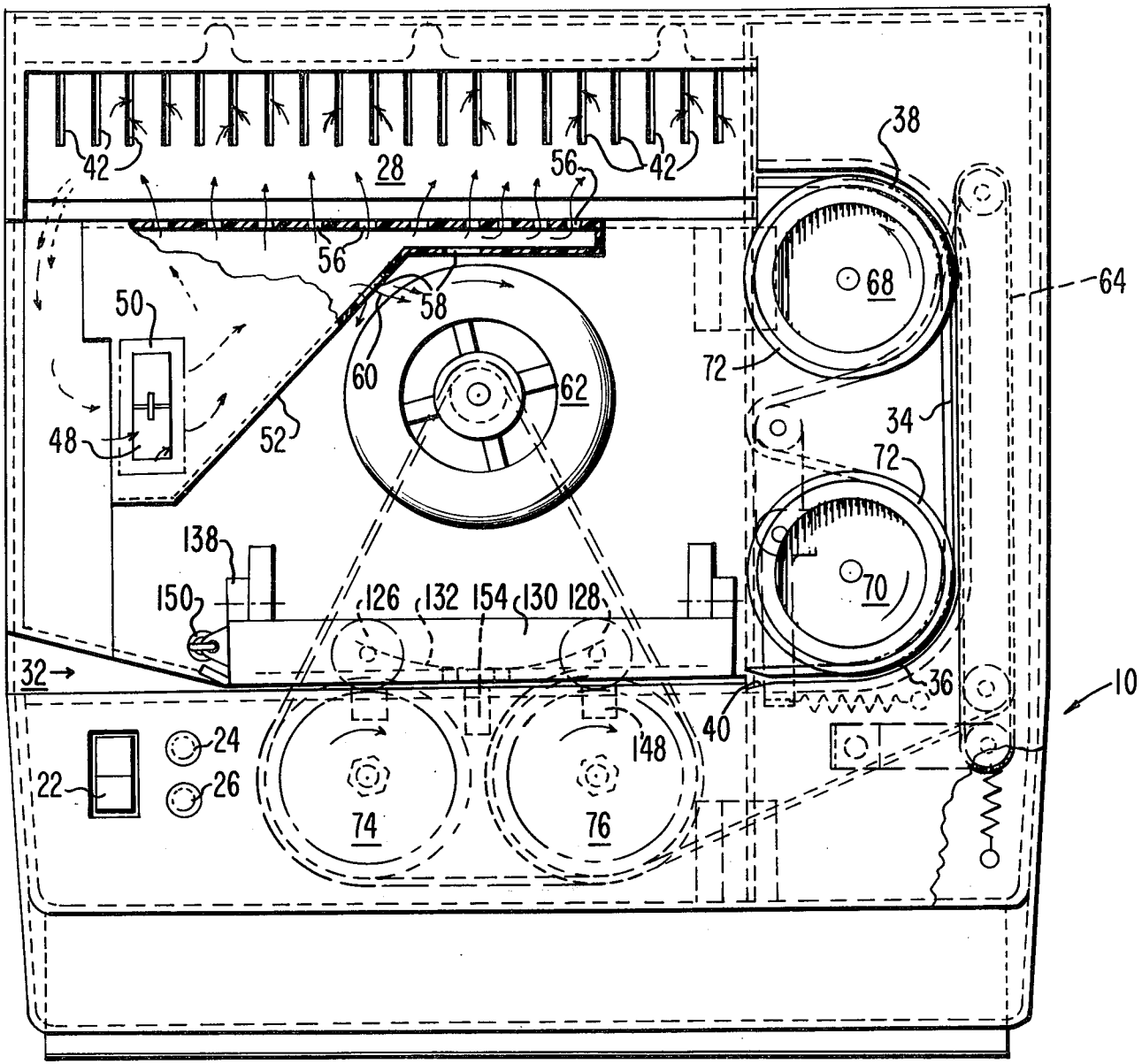
FIG. 3 is a top plan view of the apparatus of FIG. 1 illustrating the drive train in combination with the associated air flow path for the apparatus.

The various views of FIGS. 1, 2 and 3, while not drawn to actual scale, illustrate rather generally the overall configuration of the subject apparatus and its compact, modular size and arrangement of parts.

Referring first to FIG. 1 of the drawings, the item stacker apparatus 10 of the subject invention includes a base enclosure member 12 and a top cover member 14. The upper member, which is configured in two parts as hereinafter explained, is adapted to seat in a peripheral rim or groove in the lower member 12 so as to seal out dirt and dust. The front portion of the lower cover member 12 is provided with an upperwardly angled tray 16 for holding items 18 such, for example, as checks, drafts, etc. to be read and stacked by the apparatus. For ease of access to the operating area and so as to provide for routine maintenance, cleaning and the clearing of possible item jaws, the upper cover member is formed in two portions with member 20 being adapted for press or sliding fit adjacent to the item reading area, as shown in FIG. 1, and as will be described more fully hereinafter. A control "on-off" switch 22 for energizing and de-energizing the apparatus from a source of AC potential, not shown, is provided together with status lights 24 and 26 which are employed to indicate the condition of the apparatus. The upper rear portion of the apparatus is provided with a substantially rectangular pocket area 28 extending across the major portion of the back of the apparatus. An item track or pathway 30 leads in from the left front opening 32 across the machine from left to right, as in FIG. 1, thence, rearwardly to terminate leftwardly, opening into pocket 28. In order to insure the complete passage of an item from input to stacking hopper or pocket 28 a rigid, raised, grooved item guide member 34, FIG. 3, is provided along the right side wall of the stacker. Member 34 is arcuately shaped at either end so as to provide two circular bends 36 and 38 for purposes to be explained presently. The input end of item guide 34 is chamfered as at 40 to prevent any flimsy items from hanging up on the edges of the guide.

Figure 5:
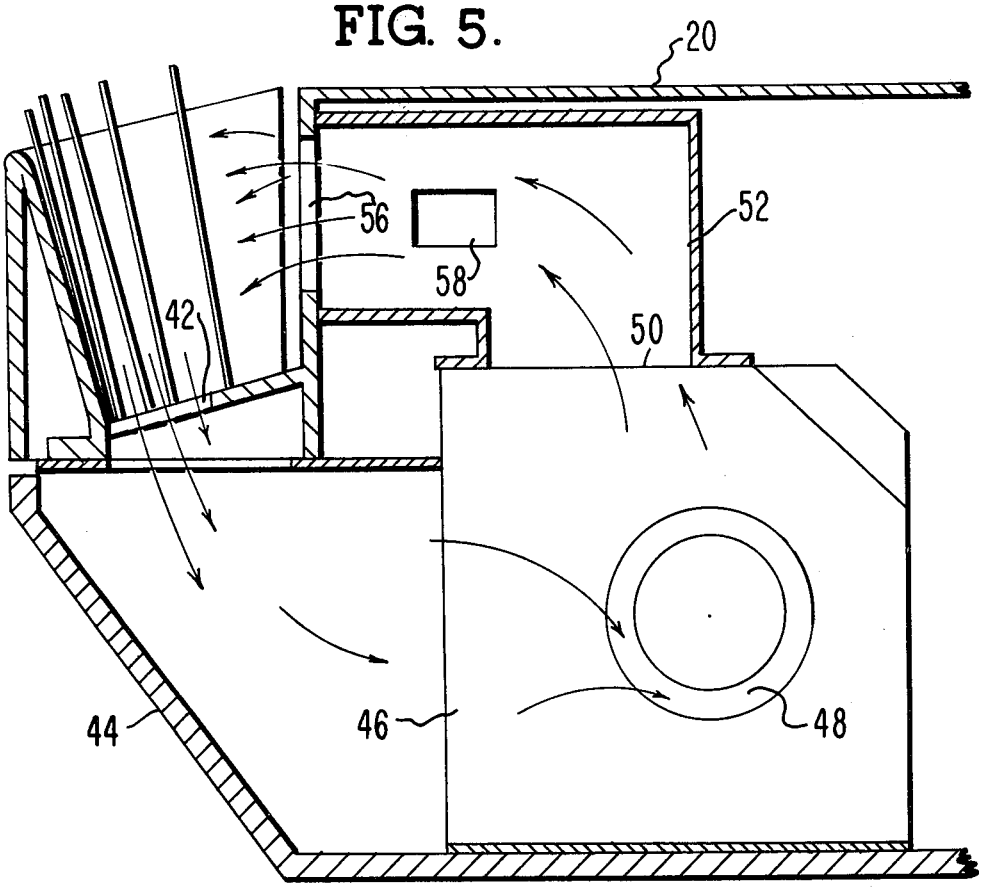
FIG. 5 is an enlarged rear end elevational view, partially in section of the air flow generating portion of the apparatus of FIG. 1.

As seen most clearly in FIGS. 2, 3 and 5, the floor of pocket 28 is provided with a plurality of elongated rectangular, slot-like openings 42 which open into a trough or plenum chamber 44, FIG. 2, therebeneath extending the length of the pocket. Plenum 44 is sealed on three sides. On the fourth side (front in FIG. 5) it opens into the lower side of air cage 46 of a high speed electric air fan 48. The upper portion 50 of the fan cage 46 opens vertically into a second plenum chamber 52 which angles leftwardly away from fan 48 and is connected to vertical wall 54, formed conjointly by the rear wall of closure member 20 and the rear of plenum 52. A plurality of vertical elongated slots or openings 56 connect the second plenum chamber 52 with the pocket 28.

The air is forced out of plenum 52 through vertically arranged slots 56 into pocket 28 to impinge upon each item as it enters pocket 28 and forces the item down the slightly angled floor of pocket 28 into contact with other previously stacked items. A small portion 60, FIG. 3, of the circulating air from the fan 48 is bled off from the main stream through the openings 58 and is used to cool the operating drive motor 62, for purposes to be described hereinafter. The slots 56 are arranged in two groups. Four slots approximately one-half inch apart and six slots approximately one-half inch apart with 1½ inches space between the two groups along the wall of plenum 52. The slots are approximately one inch long and from 0.070 to 0.080 thousands wide, about 1½ inch from the end of the pocket.

Three basic forces are employed to affect the stacking of documents: One, dynamic force due to the impingement of air from the slots 56 in the high pressure plenum 52 onto the face of the documents 18; two, the effect of reduced pressure between documents 18 due to the movement of air (velocity) towards the low pressure duct 44; three, the vectored force of gravity in the direction of the rear wall due to the slope of the pocket floor 28. These forces are taken advantage of in the present invention to permit document/items to be moved and stacked without the aid or benefit of moving structure, e.g. wheels, pulleys, gears, etc.

The biased movement of air from plenum 52 to duct 44 is caused by the air input requirements of fan 48. Ignoring leakage paths, the air follows a closed circuit path comprised of higher pressure (potential) in plenum 52, lower pressure (potential) in duct 44, and the power source at fan 48.

As the air enters the pocket 28 from plenum 52 and strikes items 18, it is sucked (negative pressure) downwardly through the slots 42 in the floor of the slanted pocket 28 into the plenum chamber 44 to be sucked back into the cage 46 of fan 48. Since the two plenum chambers are physically interconnected, the air transfer and movement continues for as long as fan 48 is energized. The negative air flow (negative pressure) at the bottom of the pocket 28 assists the entering items or documents 18 to stack uniformly against the rear wall of the pocket. The negative air pressure pumps the air out from in between the documents and thus forces the documents to come closer together as they align themselves in the pocket.

The terms "positive" and "negative" air pressure are employed in the present specification in order to more clearly explain the observable phenomena with respect to the invention. These items are words of use in the art and can be found, for example, in the following scientific treatises.

Encyclopedia Britannia, Vol. 8, page 197, column 3, copyright 1974:

> "Pressures less than atmospheric are negative gauge pressures that correspond to partial vacuums."

The International Dictionary of Physics and Electronics, D. Van Nostrand Co., Inc., Princeton, New Jersey, page 704, copyright 1956:

> "The term is often used, however, to indicate a negative gauge pressure, i.e, a pressure that is less than atmospheric, or a pressure less than 760 millimeters of mercury at 0° C."

The MICR reader will tolerate only minute variations in document velocity. In order not to interfere with the reader, the drive must slip slightly. The drive system in the present design exploits document memory and stiffness, that is, when bending a document around a radius in a narrow, confined guide channel, the document contacts and presses on certain points of the walls of the channel.

To effect the degree of slippage which is believed to be desirable and necessary, the present invention includes an elongated, endless, flat belt 64, as seen in FIGS. 1 and 3, which is arranged to be rotated in the direction of arrows 66 (by means to be described later on herein) adjacent one side wall of the apparatus and to protrude forwardly (leftwardly FIG. 1) into an overlying position relative to the channeled guideway 34, FIG. 3.

Adjacent to belt 64 are two large drive rollers 68 and 70, FIGS. 1 and 3. The outer peripheries of which are covered with silicone rubber 72. The rollers 68 and 70 are located along the inside wall of the apparatus at locations where the curvature of the document makes contact with the inside wall of the guideway 34. When the document enters curved guide channel 34 and touches the walls thereof in several places, it also makes contact with the drive belt 64 and the adjacent rollers 68 and 70. There is a 0.040" clearance between belt 64 and rollers 68 and 70 as illustrated most clearly in FIG. 6. The guide channel 34 is fabricated of low friction and wear resistant material which offers low resistance to the movement of the document. The force of the bent document 18, FIG. 2, against the rollers 68 and 70 and belt 64 produces a sufficient amount of frictional force to transport the document into the stacker pocket 28 even though, in fact, there is a space between the belt 34 and the rollers.

Figure 4:
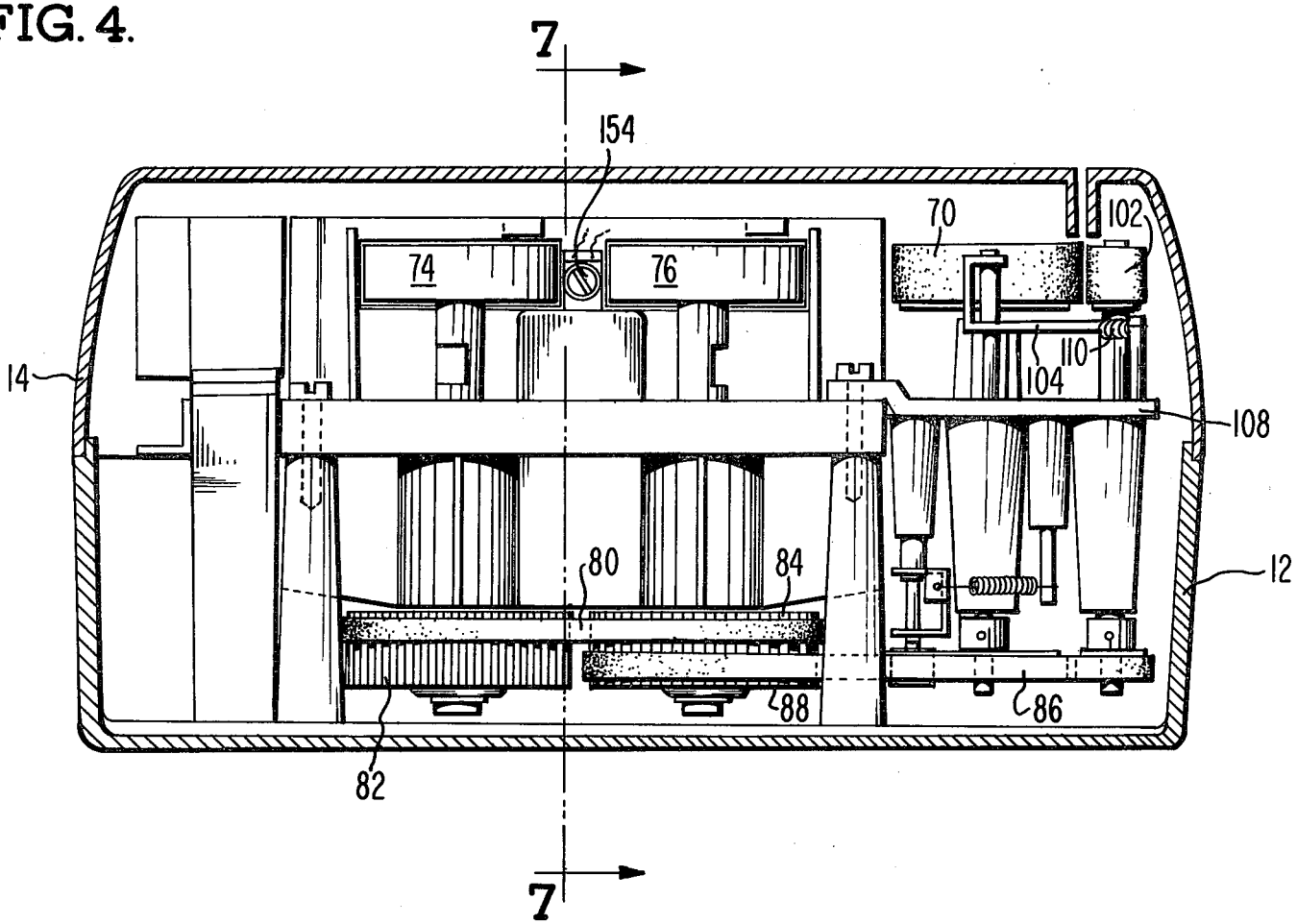
FIG. 4 is a front end elevational view of the apparatus of FIG. 1.

The main drive for the operation of the document/item transport, as seen in FIGS. 1, 3 and 4, includes main drive motor 62 and a pair of enlarged, upper drive rollers 74 and 76, FIG. 1, disposed adjacent to the item guideway 34 and rotatable by means of the drive pulley 78, toothed timing belt 80 and lower drive pulleys 82 and compound pulley 84, the latter being shaft connected to item or document drive pulleys 74 and 76. Flat drive belt 86 engaged and driven by the lower pulley wheel 88 of compound pulley 84 is entrained so as to engage and rotate tension pulley 90, drive pulley 92 and lower drive pulleys 94 and 96. Drive pulley 92 is rotatably connected to vertical shaft 98 to drive pulley 100 which in turn is drivingly engageable with drive belt 64 so as to rotate belt 64 in the direction of the arrow 66.

At the front end of the apparatus operatively engaging belt 64 is a tension pulley 102 rotatably supported on a vertical shaft disposed at the end of an L-shaped arm 104. Arm 104 is rockably supported on a vertical post 106 attached to the cross frame member 108. A tension spring 110 biases the pulley in the direction of arrow 112 such that the belt 64 is maintained under suitable tension enabling it to present an elongated flat surface to the incoming items as they are entrained within the guideway 34.

Figure 6:
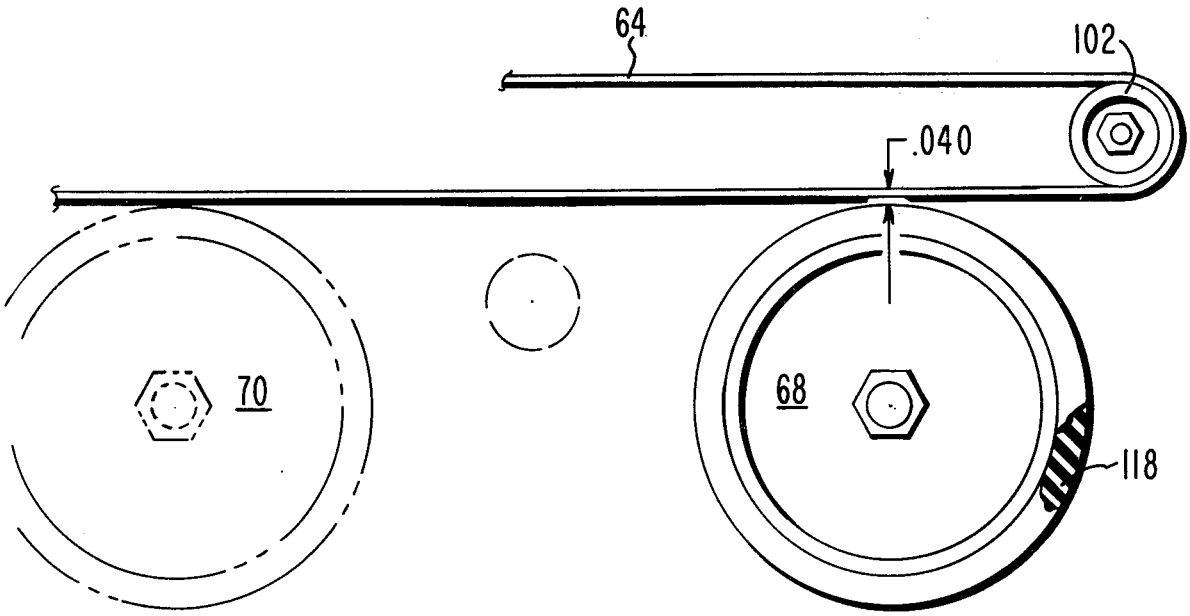
FIG. 6 is an enlarged detail view of the item stacker, drive and belt.

Pulleys 94 and 96 drive respective pulleys 68 and 70 located adjacent to belt 64 in spaced apart relation therewith as seen most clearly in FIG. 6. Each pulley 68 and 70 is provided with a silicone rubber tire 118 of a predetermined degree of friction and wear resistance for this application.

Lower drive belt 86 is maintained under the desired degree of tension by means of an irregularly shaped tension idler arm 120 carrying roller 122 at its outboard end and biased leftwardly toward belt 86 by means of spring 124.

The present apparatus is operated at a continuous, relatively high rate of speed. The surface velocity of the belt 64 and rollers 68 and 70 is in the order of 78 inches per second. Documents are fed into the system by introducing each item 18 into the throat 32, FIGS. 1, 2 and 3, thence into the bight between rollers 74 and 76 and confronting backup pressure rollers 126 and 128 resiliently supported for rotation upon arcuately, retractable member 130, FIGS. 3 and 7. A flexible, H frame shaped spring member 132, FIG. 3, permits the rollers 126 and 128 to move toward and away from the respective drive rollers 68 and 70 in order to accommodate varying thicknesses of items and so as to have driving control over the items as they pass along the guideway.

Figure 7:
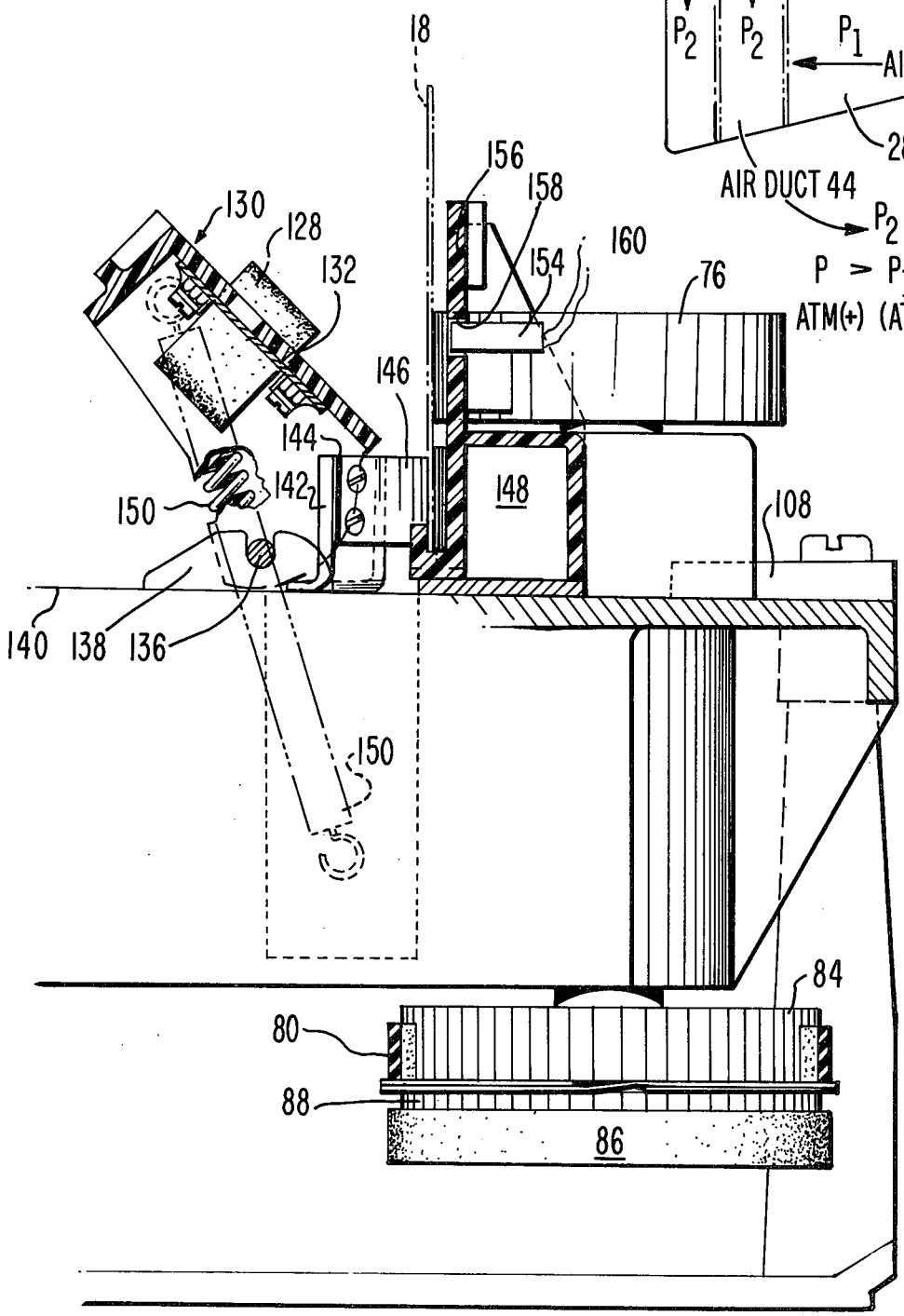
FIG. 7 is a view taken along the line 7—7 of FIG. 4.

Member 130, which comprises an irregularly shaped support to which the rollers 126 and 128 are rotatably mounted by means of the H frame 132 is pivoted on a cross shaft 136 disposed for arcuate rotation in a pair of oppositely disposed upstanding yokes 138, FIGS. 3 and 7, only one of which is clearly shown in FIG. 7.

Directly beneath each roller 126 and 128, and fixedly secured to the frame 140, is a backup anvil 142 carrying a resilient pad 144 of silicone rubber or similar material. A flexible, yieldable strip 146 of spring material, e.g. brass, stainless steel, etc., is secured to anvil 142 so that the free end portion curves outwardly away therefrom to abut the front surface of the read head 148, the latter being axially aligned with the rotative axis of pulley 76.

Member 130 is provided with an over-center biasing spring 150 secured at its upper end to the top portion of member 130 and at its lower end to the base of well-like access opening 152.

An item indicating device 154, e.g. photo-transistor, photodiode, etc., is positioned in the front wall 156, FIG. 7, of the item guideway 30 so that the active end portion thereof extends through an opening or aperture 158 in wall 156 to bring the device flush with the front surface of wall 156 for interception by the items passing through the guideway 30.

Operation

Items such as, for example, checks, bills, drafts, etc. are temporarily stored in the open trough-like receptacle 16 at the front of the stacker. Each item 18 is fed into throat 32 so that with the mechanism energized by means of on-off switch 22, the item is gripped between the rotating rollers 74 and 76 and the backup rollers 126 and 128 effectively causing the indicating device 154 to produce an output over lines 160 energizing the read head 148 and reading the magnetic data (MICR encoding) from the item for use by associated electronic hardware, not shown. The document velocity in the reader area is 75 inches per second. The surface velocity of the belt and roller is 78 inches per second. This difference in velocity allows for slippage and there is not enough frictional force to cause distortion of the document velocity while any part of the document is still within the MICR reader area. The force that holds the item in the MICR section is close to two pounds. The force generated with the present transport system is a maximum of three-and-a-half ounces and a minimum of 0.05 of an ounce depending on the type of item (thickness, width and length). The force is just sufficient to move the document into the stacker but not high enough to pull the document out of the MICR position. Additionally, should there be an accidental stoppage for some reason or other in the transport area, the document-/item would not be damaged by the transport mechanism. After removal of the blockage, the items can proceed automatically into the stacker.

As earlier mentioned herein, the present apparatus utilizes forced air flow to control and stack the items without other moving parts being involved. The stacker pocket 28 is a long, well-like receptacle with the bottom inclined 15 degrees toward the front wall of the stacker pocket. Along the bottom of the pocket are narrow slots 42 (20 slots 0.5 inches apart, 0.05 wide and 1.12 inches long). The front wall of the pocket has a series of openings 10 (0.070–0.080 wide and 1.00 high) over the full length thereof approximately 0.7 inches high from the bottom, 1.00 upward.

As the items 18 leave the MICR reading station or area, they follow curved guide channel 34 touching the walls of the channel in several places and also contacting the elongated drive belt 64 and rollers 68 and 70. The force of the item against the rollers 68 and 70 and belt 64 produces sufficient amount of frictional force to transport the item into the stacker pocket.

Figure 8:
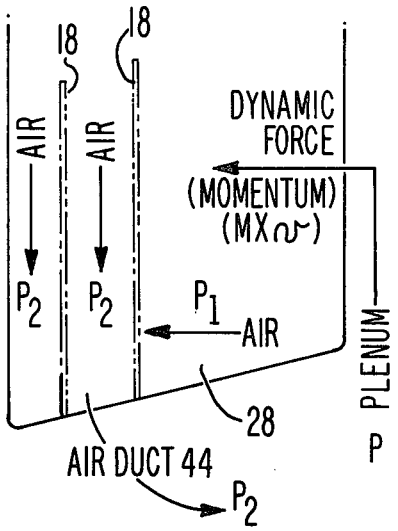
FIG. 8 is a pictorial diagram of the air flow utilized with the present invention.

Referring to FIG. 8, it is seen that when the item 18 enters the pocket 28, it is pushed by the positive air pressure against the rear wall by the air coming from the blower fan through the front wall openings 56. The velocity of the entering item is sufficient to bring the item fully into the pocket to abut the leading end thereof against the end wall of the pocket. The negative air pressure created by the configuration of the plenum chambers pumps the air out from in between the item documents forcing them closer together to stack firmly against the rear wall of the pocket. The negative air pressure helps to straighten out bent and/or folded items while at the same time eliminating and/or preventing items from tangling and interfering with each other as the incoming documents present themselves to the stacker.

What is claimed is:

1. Document stacking apparatus comprising an open document receiving receptacle;

means for applying continuous positive air pressure to said receptacle to deflect a document out of the path of other documents entering said receptacle; and means for producing conntinuous negative air pressure within said receptacle by withdrawing air from between the stacked documents effectively forcing said documents to closely bunch together within said receptacle.

2. The invention in accordance with claim 1 wherein said document receiving receptacle comprises an elongated shallow rectangular member having a slotted floor for the displacement of air under vacuum therefrom and having a plenum chamber therebeneath effective to lead the relatively low negatively pressurized air flow back to the source of positive air pressure.

3. The invention in accordance with claim 1 wherein the means for applying air under pressure to said document receiving receptacle comprises a blower member having an enclosed peripheral chamber or shroud with an inlet for reception at low level negative pressurized air and an outlet for developing positive pressureized air and a plenum chamber interconnected with said document receiving receptacle for applying positive air pressure to said receptacle.

4. The invention in accordance with claim 3 wherein the high (positive) and low (negative) air pressure producing means are disposed at right angles to one another.

5. Air assisted document stacking apparatus comprising:

drive means including means coupling said drive means to means for continuously moving documents from an input throat to an output stacking hopper;

a document stacking hopper;

a reading station for reading magnetic data from said document;

means for moving a document from said reading station to said stacking hopper including a curvilinear guideway and a pair of parallel high speed rollers disposed adjacent to and slightly overlapping said guideway, an elongated drive member in confronting relation to but out of contact with said rollers and overlying said guideway effective to cause said document to be forced around said rollers so that said document contacts said rollers, said elongated drive member and said guideway only intermittently but with sufficient force to transport the document into the stacker pocket; and means applying air under continuous pressure to said hopper to move said documents within said hopper and duct means for creating a continuous lowered negative pressure with respect to the air entering said hopper effective to withdraw air from between documents in said hopper causing said documents to be stacked tightly together.

6. The invention in accordance with claim 5 wherein said drive means includes a first belt drive means for moving said documents through said read station and a second belt drive means coupled to said first drive means for causing said documents to move through said curvilinear guideway and into said stacking hopper.

7. The invention in accordance with claim 5 wherein said curvilinear guideway comprises a raised walled track of substantially U-shaped configuration extending from said read station to said output hopper and of sufficient depth to prevent said documents from being deflected out away therefrom but insufficient in height to enclose the documents or interfere with its passage or removal should a jam occur.

8. The invention in accordance with claim 5 wherein said elongated drive means comprises a plastic coated fabric member extending from a point well ahead of the first of said pair of rollers at one end of said guideway to a point well beyond the opposite one of said pair of rollers at the opposite end of said guideway and being sufficiently wide to provide side support for said documents as said documents are abruptly diverted along said guideway from said reading station to said output hopper.

9. The invention in accordance with claim 5 wherein said output hopper comprises an elongated trench-like receptacle provided with means in the floor thereof for displacing air under vacuum therefrom and having a plenum chamber therebeneath effective to lead the low negatively pressurized air flow back to the source of positive air pressure.

* * * * *